US008167423B2

(12) United States Patent
Mochizuki

(10) Patent No.: US 8,167,423 B2
(45) Date of Patent: May 1, 2012

(54) INK JET APPARATUS

(75) Inventor: Seiji Mochizuki, Hata-machi (JP)

(73) Assignee: Seiko Epson Corporation, Tokyo (JP)

( * ) Notice: Subject to any disclaimer, the term of this patent is extended or adjusted under 35 U.S.C. 154(b) by 614 days.

(21) Appl. No.: 12/342,318

(22) Filed: Dec. 23, 2008

(65) Prior Publication Data

US 2009/0167833 A1 Jul. 2, 2009

(30) Foreign Application Priority Data

Dec. 28, 2007 (JP) ..... 2007-339034
Oct. 9, 2008 (JP) ..... 2008-263162

(51) Int. Cl.
*B41J 2/01* (2006.01)

(52) U.S. Cl. ..... 347/104; 347/101

(58) Field of Classification Search ..... 347/104, 347/101, 2, 4
See application file for complete search history.

(56) References Cited

U.S. PATENT DOCUMENTS

| | | | | |
|---|---|---|---|---|
| 4,109,782 | A * | 8/1978 | Nakai | 198/781.03 |
| 4,551,887 | A * | 11/1985 | Uematsu | 19/244 |
| 5,481,290 | A * | 1/1996 | Watanabe et al. | 347/104 |
| 5,594,486 | A * | 1/1997 | Kiyohara | 347/104 |
| 5,762,332 | A * | 6/1998 | Haroutel et al. | 271/274 |
| 5,818,487 | A * | 10/1998 | Yoshimura et al. | 347/104 |
| 6,536,896 | B1 * | 3/2003 | Kan | 347/104 |
| 6,892,977 | B2 * | 5/2005 | Boone et al. | 242/595.1 |
| 7,798,602 | B2 * | 9/2010 | Kobayashi et al. | 347/37 |
| 7,914,217 | B2 * | 3/2011 | Silverbrook et al. | 400/649 |
| 7,954,804 | B2 * | 6/2011 | Uchida et al. | 271/9.12 |
| 2004/0112534 | A1 * | 6/2004 | Koizumi et al. | 156/344 |
| 2005/0018029 | A1 * | 1/2005 | Takagi et al. | 347/104 |
| 2006/0023053 | A1 * | 2/2006 | Sasa et al. | 347/104 |

FOREIGN PATENT DOCUMENTS

| | | | |
|---|---|---|---|
| FR | 2720332 | A1 * | 12/1995 |
| JP | 56048623 | A * | 5/1981 |
| JP | 06-015818 | | 1/1994 |
| JP | 07-214766 | | 8/1995 |
| JP | 07-214767 | | 8/1995 |

* cited by examiner

*Primary Examiner* — Stephen Meier
*Assistant Examiner* — Leonard S Liang
(74) *Attorney, Agent, or Firm* — Workman Nydegger

(57) ABSTRACT

An ink jet textile printing apparatus includes a printing section having a recording head and performing printing on a recording medium by ejecting ink from the recording head, a transporting belt having an adhesive surface, and a lifting preventer disposed on an upstream side with respect to the printing section in a transporting direction in which the transporting belt is rotated. The lifting preventer includes a free roller that is provided over the recording medium adhered to and supported by the transporting belt and is movable in the transporting direction and in a direction opposite to the transporting direction.

9 Claims, 9 Drawing Sheets

INK JET APPARATUS

BACKGROUND

1. Technical Field

The present invention relates to ink jet textile printing apparatuses that each perform printing on a textile by ejecting ink from an ink jet recording head.

2. Related Art

Until recent years, printing on textiles made of cotton, silk, wool, chemical fiber, blended yarn, and the like was mainly performed using screen printing apparatuses that require stencils. In recent years, however, with the technological advancement of ink jet printers, ink jet textile printing apparatuses based on the ink jet printing technique have been attracting attention.

In ink jet textile printing, no stencils, which are required in screen printing, are required and digitalized designs can be utilized. Hence, quick responses to detail design changes, for example, can be realized in accordance with customers' needs. Furthermore, the production time can be largely reduced. In addition, design flexibility is advantageously high, enabling color gradation, for example.

In an ink jet textile printing apparatus, when cloth, i.e., a recording medium, is transported toward a printing section that performs ink jet printing, the cloth is pasted to a transporting belt having an adhesive surface so that transportation accuracy can be improved. In this state, the transporting belt is rotated by transporting rollers or the like.

In the case where cloth is pasted to the transporting belt having an adhesive surface, air may become trapped in some regions between the transporting belt and the cloth, resulting in lifting of such regions of the cloth from the transporting belt.

If cloth is transported to a position below the printing section in a state where any regions of the cloth are lifted by air, the lifted regions may interfere with the recording head of the printing section, causing problems such as contamination of the cloth and damage to the recording head. Moreover, if printing is performed on cloth having any regions thereof lifted by air, another problem may arise in that the quality of an image printed thereon is deteriorated. Particularly, in a case where cloth has a large width, it is more difficult to evenly paste the cloth to the transporting belt. This increases the probability of occurrence of the aforementioned problems.

To evenly paste the cloth to the transporting belt, referring to FIG. 10, an exemplary ink jet textile printing apparatus 31 disclosed in JP-A-7-214766 includes a pasting roller 32 disposed at a position on the upstream side with respect to a printing section 4 and facing a transporting roller 15 across a transporting belt 7 so as to urge cloth 2 with a predetermined force.

In such a configuration, however, if a large region of the cloth 2 is lifted by a large amount of air, the cloth 2 that has been squeezed between the pasting roller 32 and the transporting roller 15 may be pasted with wrinkles to the transporting belt 7.

SUMMARY

An advantage of some aspects of the invention is that it provides an ink jet textile printing apparatus capable of performing printing with high image quality by smoothing regions of cloth lifted by air trapped between a transporting belt and the cloth during transportation of the cloth, which is made to adhere to the transporting belt having an adhesive surface, toward a position below a printing section. The air trapped in the lifted regions is evenly dispersed, whereby the cloth is made to adhere in a flat state to the transporting belt.

According to an aspect of the invention, an ink jet textile printing apparatus includes a printing section having a recording head and performing printing on a recording medium by ejecting ink from the recording head, a transporting belt having an adhesive surface, and a lifting preventer disposed on an upstream side with respect to the printing section in a transporting direction in which the transporting belt is rotated. The lifting preventer includes a free roller that is provided over the recording medium adhered to and supported by the transporting belt and is movable in the transporting direction and in a direction opposite to the transporting direction.

The free roller included in the lifting preventer is provided over cloth, i.e., the recording medium, adhered to and supported by the transporting belt. The free roller has no fixed shaft. The free roller is provided in a state where only the weight of the free roller itself is applied to the cloth and the transporting belt. Specifically, the free roller can move freely in the transporting direction in which the transporting belt is rotated and in the opposite direction. Therefore, when the transporting belt of a recording medium transporting section is rotated, the free roller can freely roll over on the transporting belt in the transporting direction and in the opposite direction. Further, the free roller, having no fixed shaft as described above, rolls irregularly.

The aspect of the invention provides an advantage in that the "irregular movement (rolling)" of the free roller disposed on the upstream side on the transporting belt with respect to the printing section smoothes, without wrinkling, regions of the cloth lifted by air trapped between the transporting belt and the cloth, whereby the cloth can be made to adhere to the transporting belt in a flat state. The "irregular movement" of the free roller will be described in more detail.

Referring to FIG. 11 showing the known example described above, in the case where the pasting roller 32 having a fixed shaft urges the cloth 2 with a certain force, the cloth 2 is squeezed between the pasting roller 32 and the transporting belt 7. This often makes the cloth 2 wrinkle because of an unnatural force applied thereto.

In the aspect of the invention, the free roller can move freely as described above. Therefore, if the cloth has a lifted region, in which air is trapped between the transporting belt and the cloth, leading to wrinkling that may occur when the free roller rolls thereover while pressing the lifted region, the free roller bounces off the lifted region and rolls toward a side where there are no lifted regions. Then, if the free roller bumps into another lifted region of the cloth, the free roller bounces off the another lifted region and continues rolling. When such an "irregular movement" of the free roller is repeated, air trapped between the transporting belt and the cloth is dispersed evenly. Thus, the cloth can be flattened without becoming wrinkled.

For example, in a case where a single free roller is used, it is preferable that the free roller have a length larger than the width of the recording medium so as to be capable of dispersing air trapped in any regions of the recording medium. In a case where there is a relatively small probability of occurrence of an air-lifted region that is so large as to interfere with the recording head of the printing section and printing is to be performed only on a portion of the recording medium, the free roller may have a smaller length that is just sufficient to evenly disperse the air trapped in that portion of the recording medium on which printing is to be performed, whereby the widthwise range within which the free roller rolls can be limited.

In the ink jet textile printing apparatus according to the aspect of the invention, it is also preferable that the free roller include a plurality of the free rollers arranged in the transporting direction.

With such a configuration, the free rollers roll over on the recording medium while individually making the "irregular movements". Therefore, the air trapped between the transporting belt and the recording medium can be assuredly dispersed while the recording medium is transported, whereby the recording medium can be flattened.

In a first preferable configuration of the ink jet textile printing apparatus according to the aspect of the invention, the free roller includes a plurality of the free rollers arranged in the transporting direction, the free rollers having respective diameters that increase in order from a most upstream one to a most downstream one in the transporting direction.

In a case where a large region of cloth, i.e., the recording medium, is lifted by air trapped between the cloth and the transporting belt, if a free roller having a large diameter and a heavy weight directly rolls over the large air-lifted region, the cloth may wrinkle.

In the first preferable configuration, not only the advantage brought by the aspect of the invention but another advantage described as follows is also provided. A large air-lifted region can be first made smaller to some extent, without causing the cloth to wrinkle, by the lightest one of the free rollers having the smallest diameter and disposed at the most upstream position in the transporting direction. Since the diameters of the free rollers increase toward the downstream side, the air-lifted region that has been made smaller to some extent by the free roller having the smallest diameter is made even smaller, while the air thereinside is dispersed, sequentially by the other free rollers having diameters and weights larger than those of the free roller having the smallest diameter. With the free rollers having different diameters increasing in order from the upstream side toward the downstream side in the transporting direction, even in a case where the cloth easily allows a large amount of air to be trapped thereunder on the transporting belt, the air can be dispersed evenly and the cloth can be flattened without becoming wrinkled.

In a second preferable configuration of the ink jet textile printing apparatus according to the aspect of the invention, the transporting belt is driven intermittently.

In the second preferable configuration, not only the advantage brought by the aspect of the invention but also another advantage is provided in that the free roller can move more easily with a rebound produced by the intermittent driving of the transporting belt, whereby air trapped between the recording medium and the transporting belt can be efficiently dispersed and consequently the recording medium on the transporting belt can be flattened.

A third preferable configuration of the ink jet textile printing apparatus according to the aspect of the invention further includes a movement regulating member that regulates a range within which the free roller moves.

In the third preferable configuration, not only the advantage brought by the aspect of the invention but also another advantage is provided in that the free roller can be made to move freely within a preset range, whereby the "irregular movement" of the free roller can be realized in a stable manner.

A fourth preferable configuration of the ink jet textile printing apparatus according to the aspect of the invention further includes a roller movement promoting member that promotes movement of the free roller.

To "promote" the movement of the free roller means that the roller movement promoting member applies a force causing the free roller moving closer to and coming into contact therewith not to remain in contact therewith but to bounce thereof.

In the fourth preferable configuration, not only the advantage brought by the aspect of the invention but also another advantage is provided in that the roller movement promoting member that promotes the free movement of the free roller contributes to more efficient dispersion of the air trapped between the recording medium and the transporting belt, whereby the recording medium on the transporting belt can be flattened.

In a fifth preferable configuration of the ink jet textile printing apparatus according to the fourth preferable configuration, the roller movement promoting member is a resilient member including a spring or a resin member, or has a shape enabling the free roller that has bumped thereinto to easily bounce thereof.

The fifth preferable configuration provides an advantage in that the effect of promoting the movement of the free roller can be realized with a simple configuration.

In the aspect of the invention, the lifting preventer may include a plurality of the free rollers having lengths smaller than the width of the recording medium.

This provides an advantage in that the free rollers having smaller lengths make smaller irregular movements, whereby air trapped between the recording medium and the transporting belt can be efficiently dispersed and the recording medium on the transporting belt can be flattened.

Further, it is preferable that the free rollers having lengths smaller than the width of the recording medium be arranged over the entire width of the recording medium in such a manner that adjacent ones of the free rollers have portions thereof overlapping each other so that the air trapped in any regions of the recording medium can be dispersed. In the case where there is a relatively small probability of occurrence of an air-lifted region that is so large as to interfere with the recording head of the printing section and printing is to be performed only on a portion of the recording medium, the free rollers having small lengths may be arranged only in that portion of the recording medium on which printing is to be performed, so as to evenly disperse the air trapped therein, whereby the widthwise range within which the free rollers roll can be limited.

In a sixth preferable configuration of the ink jet textile printing apparatus according to the aspect of the invention, the lifting preventer includes a plurality of the free rollers having lengths smaller than a width of the recording medium, the free rollers each being arranged obliquely in such a manner as to have one end thereof near a side of the recording medium resides on a downstream side in the transporting direction with respect to the other end thereof.

In the sixth preferable configuration, an advantage described as follows is provided. The free rollers having smaller lengths make smaller irregular movements. Therefore, air trapped between the recording medium and the transporting belt can be efficiently dispersed and the recording medium on the transporting belt can be flattened. In addition, the sixth preferable configuration facilitates the movement of the free rollers to push the air trapped between the recording medium and the transporting belt toward the sides of the recording medium. Thus, the air can be dispersed efficiently.

Further, it is preferable that the free rollers having lengths smaller than the width of the recording medium be obliquely arranged over the entire width of the recording medium in such a manner that adjacent ones of the free rollers have portions thereof overlapping each other so that the air trapped in any regions of the recording medium can be dispersed. In the case where there is a relatively small probability of occurrence of an air-lifted region that is so large as to interfere with the recording head of the printing section and printing is to be performed only on a portion of the recording medium, the free rollers having small lengths may be arranged only in that portion of the recording medium on which printing is to be performed, so as to evenly disperse the air trapped therein, whereby the widthwise range within which the free rollers roll can be limited.

In the aspect of the invention, the free roller may be held by a plate-like roller holding member having an opening serving as a frame enclosing the free roller.

In such a configuration, not only the advantage brought by the aspect of the invention but also another advantage is provided in that the free roller can be held with a simple configuration.

Thus, according to the aspect of the invention, regions of the recording medium lifted by air trapped between the transporting belt and the recording medium is smoothed during transportation of the recording medium, which is made to adhere to the transporting belt having an adhesive surface, toward a position below the printing section. The air trapped in the lifted regions is evenly dispersed, whereby the recording medium is made to adhere in a flat state to the transporting belt. By transporting the recording medium that has been made to adhere evenly and in a flat state to the transporting belt toward the printing section, printing with high image quality can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
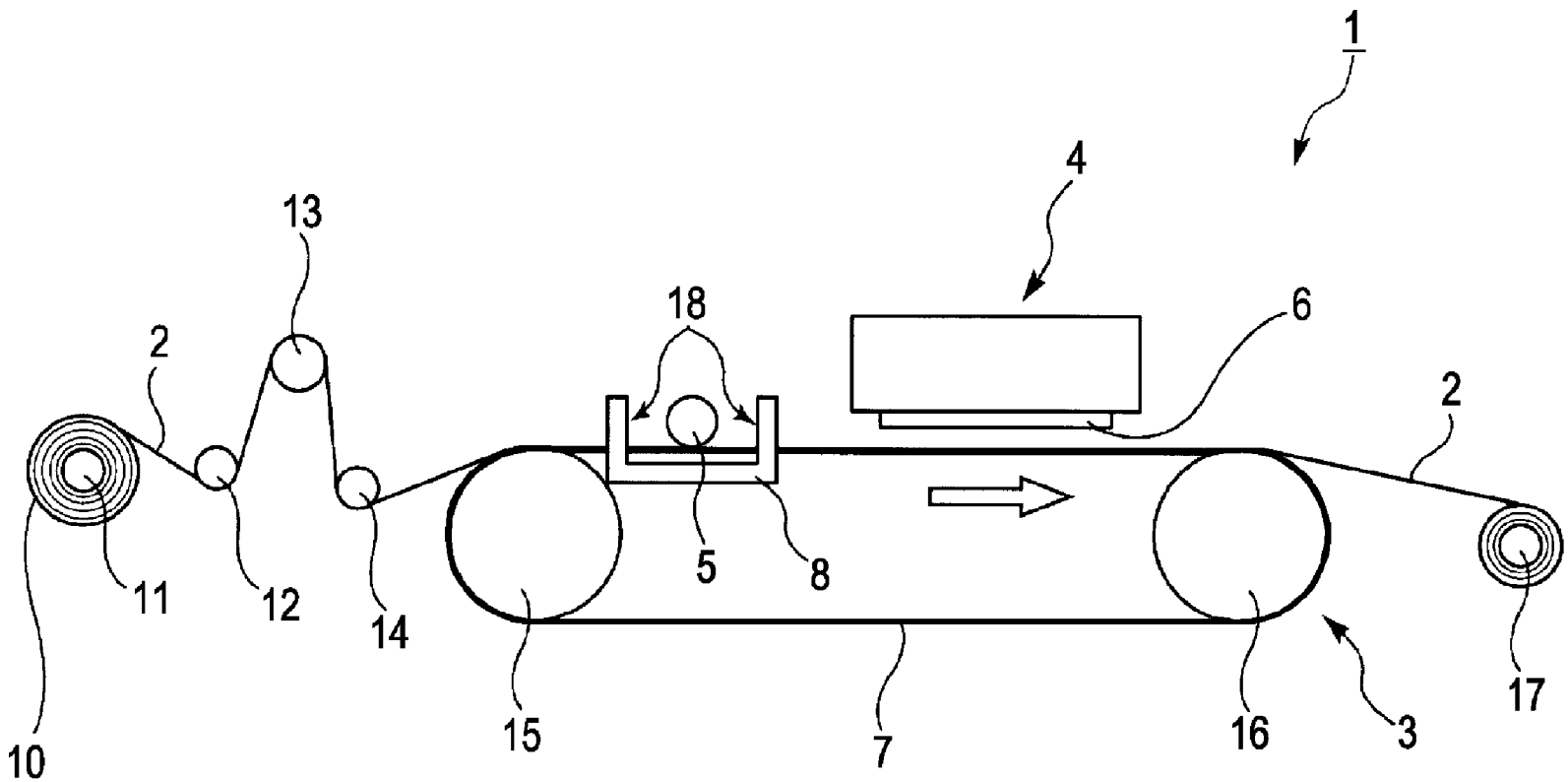
FIG. 1 schematically shows relevant parts of an example of an ink jet textile printing apparatus according to a first embodiment of the invention.

FIG. 1 schematically shows relevant parts of an example of an ink jet textile printing apparatus 1 according to a first embodiment of the invention. The recording medium used in the first embodiment is cloth 2 made of a material such as cotton, silk, wool, chemical fiber, or blended yarn. The cloth 2, which is usually wound up in a form of a roll 10 before being subjected to ink jet printing, is unwound from the roll 10 by a feed roller 11 and is guided via intermediate rollers 12, 13, and 14 toward a transporting belt 7 of a recording medium transporting section 3.

In the recording medium transporting section 3, the transporting belt 7 in a form of a loop is rotated by transporting rollers 15 and 16. The white arrow in FIG. 1 indicates a direction in which the transporting belt 7 is rotated and the cloth 2 is transported.

The transporting belt 7 has on a surface thereof an adhesive layer (not shown) composed of an adhesive called glue. The cloth 2 unwound from the roll 10 is transported to a position below a printing section 4 while being made to adhere to and supported by the surface of the transporting belt 7. The configuration around the transporting rollers 15 and 16 that rotate the transporting belt 7 is not limited to the one described above. For example, a sub-roller that helps the transporting belt 7 rotate or a platen roller that supports the transporting belt 7 at a position below the printing section 4 may also be provided between the transporting rollers 15 and 16 so that the cloth 2 adhered to the surface of the transporting belt 7 can be transported stably.

The intermediate roller 14 disposed nearest the transporting belt 7 on the upstream side thereof is desirably disposed at a lower level relative to the level at which the transporting surface of the transporting belt 7 resides so that the cloth 2 can be easily made to adhere to the surface of the transporting belt 7.

The printing section 4 includes a recording head 6 that performs ink jet printing. The printing section 4 performs printing on the cloth 2 that has been transported to a position below the printing section 4 by ejecting ink thereto. After printing on the cloth 2 placed at the position below the recording head 6 of the printing section 4 is performed, the cloth 2 is separated from the transporting belt 7 and is wound up by a winding roller 17.

Figure 2:
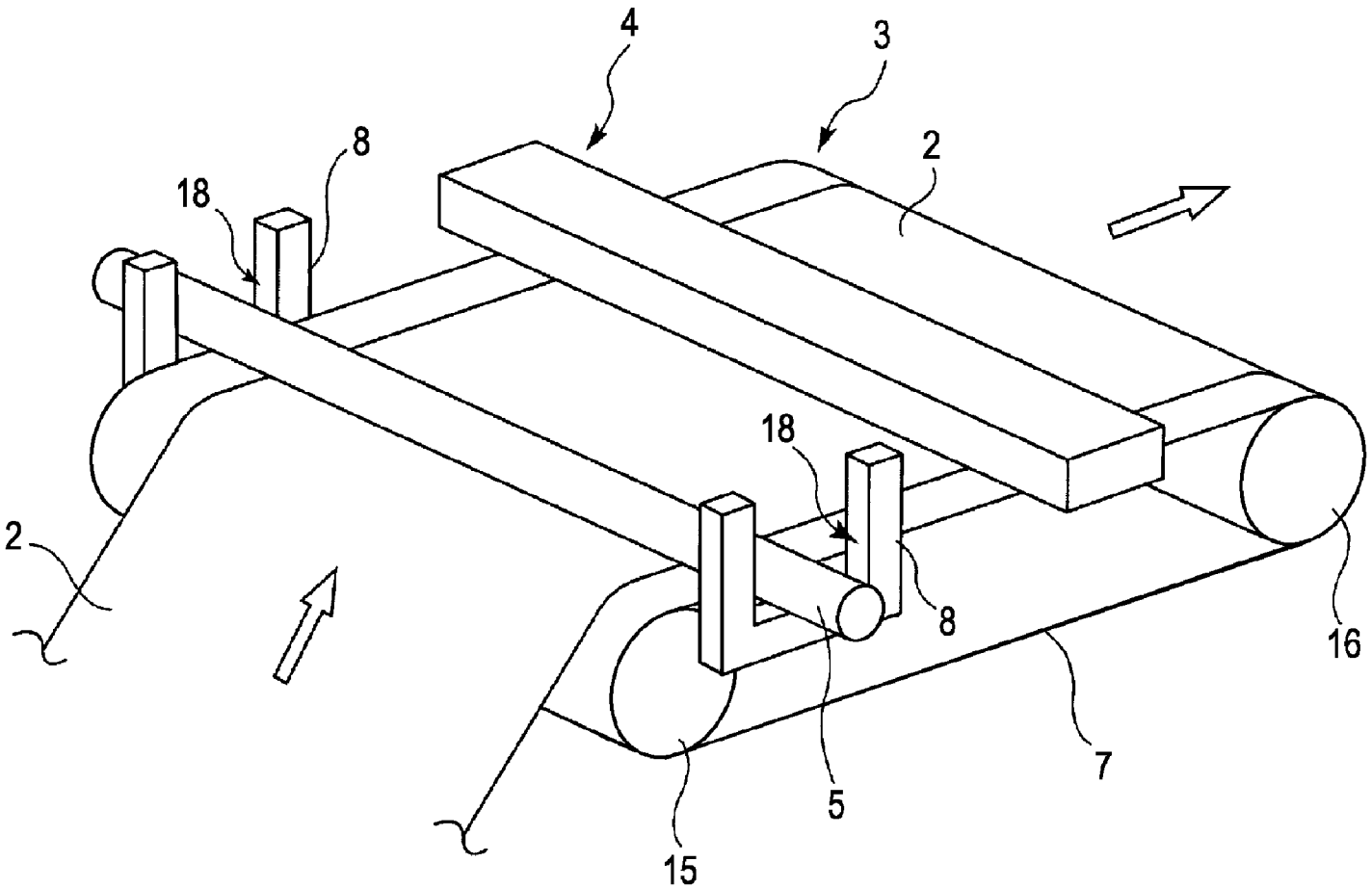
FIG. 2 is a perspective view showing an example of a lifting preventer of the ink jet textile printing apparatus according to the first embodiment of the invention.

A free roller 5, as a lifting preventer that prevents lifting of the recording medium from the transporting belt 7, is disposed on the upstream side with respect to the printing section 4. FIG. 2 is a perspective view showing an example of the lifting preventer of the ink jet textile printing apparatus 1 according to the first embodiment of the invention. When the cloth 2 is made to adhere to the transporting belt 7, air may be trapped between the transporting belt 7 and the cloth 2, and some regions of the cloth 2 may be lifted from the transporting belt 7. The lifting preventer smoothes out the cloth 2 having some regions thereof lifted from the transporting belt 7 at a position on the upstream side (the white arrow in FIG. 2 indicates the direction in which the cloth 2 is transported) with respect to the printing section 4 so as to prevent the cloth 2 that is to be transported to the position below the printing section 4 from having such lifted regions.

The free roller 5 will be described in detail.

The free roller 5 is a stick-like roller and can be made of metal, ceramic, or the like. The free roller 5 has a length larger than the width of the cloth 2, i.e., the recording medium, and is provided over the cloth 2 that is made to adhere to and supported by the transporting belt 7. The free roller 5 is movable freely in a transporting direction in which the transporting belt 7 is rotated and in the opposite direction. In short, the free roller 5 has no fixed shaft. Only the weight of the free roller 5 itself is applied to the cloth 2 and the transporting belt 7. The diameter and the weight of the free roller 5 are desirably set in accordance with the type and thickness of the cloth 2, i.e., the recording medium.

In the case of the first embodiment where a single free roller 5 is used, it is preferable that the length of the free roller 5 be larger than the width of the cloth 2, i.e., the recording medium, so that air trapped under any regions of the recording medium can be dispersed. In a case where there is a relatively small probability of occurrence of an air-lifted region that is so large as to interfere with the recording head 6 of the printing section 4 and printing is to be performed only on a portion of the cloth 2, the free roller 5 may have a smaller length that is just sufficient to evenly disperse air trapped in that portion on which printing is to be performed, whereby the widthwise range within which the free roller 5 rolls can be limited.

When the transporting belt 7 of the recording medium transporting section 3 is rotated, the free roller 5 freely rolls over on the transporting belt 7 in the transporting direction and in the opposite direction. Since the free roller 5 has no fixed shaft, the free roller 5 rolls irregularly.

Figure 11:
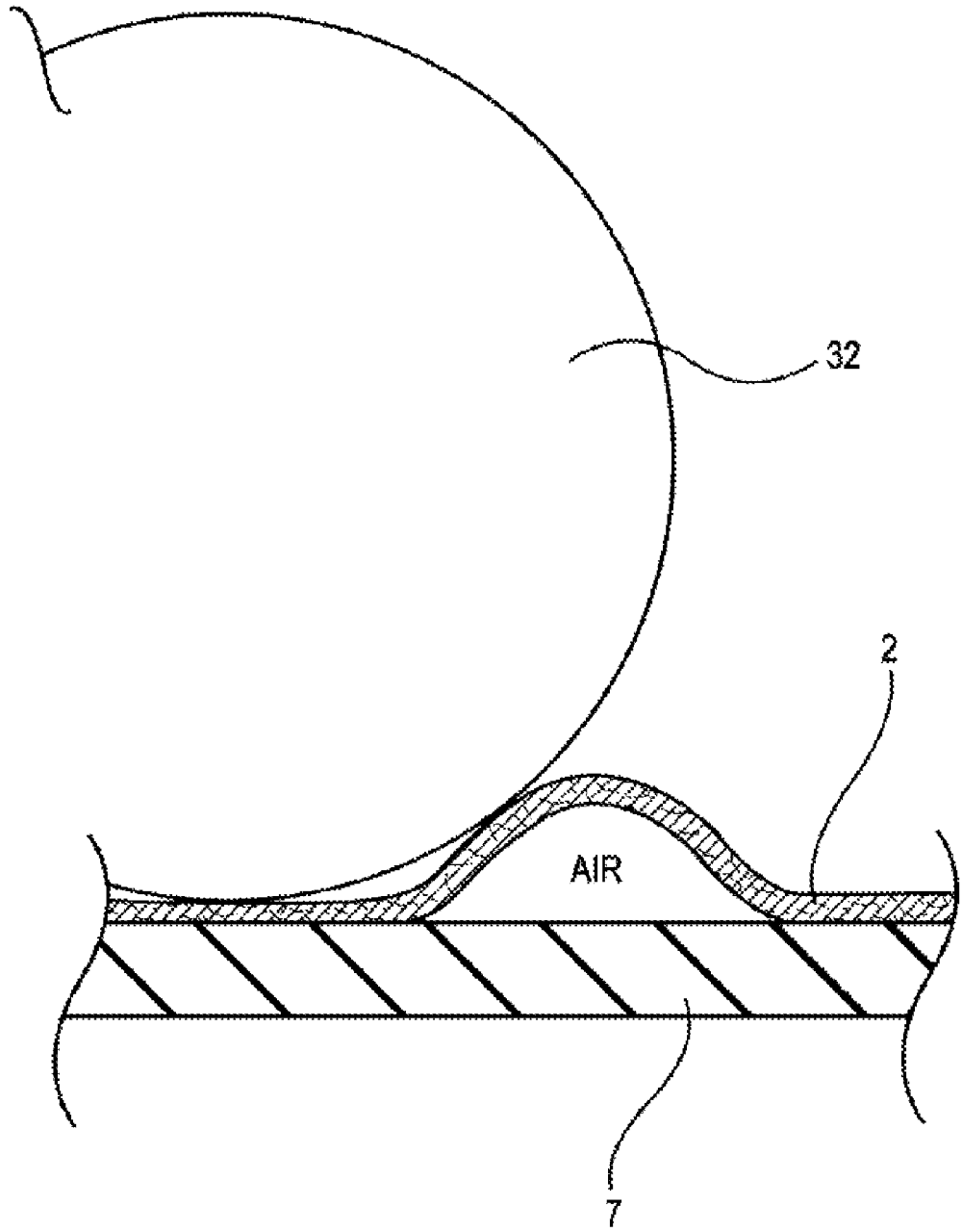
FIG. 11 PRIOR ART
FIG. 11 is a side cross-sectional view showing a problem occurring in the known ink jet textile printing apparatus.

The free roller 5 rolling as described above presses regions of the cloth 2 in which air is trapped between the transporting belt 7 and the cloth 2. When the cloth 2 has a lifted region (such as the one shown in FIG. 11 formed in the case where the pasting roller 32 is used) that may lead to wrinkling, the free roller 5 bounces off the lifted region and thus can roll toward a side where there are no lifted regions. If there is another lifted region at a position toward which the free roller 5 is to roll, the free roller 5 that is rolling presses the another lifted region, causing yet another region of the cloth 2 to be lifted. Then, the free roller 5 bounces off the yet another lifted region.

When such an "irregular movement (rolling)" of the free roller 5 is repeated, air between the transporting belt 7 and the cloth 2 is dispersed evenly. Thus, the cloth 2 can be flattened without becoming wrinkled.

In the first embodiment, the range of free movement of the free roller 5 is preset by providing movement regulating members 8. By allowing the free roller 5 to freely move within the preset range, the "irregular movement" of the free roller 5 can be realized in a stable manner. The range of free movement is preferably set in accordance with the diameter of the free roller 5 and the type and thickness of the cloth 2, i.e., the recording medium. Further, if the movement regulating members 8 include movement regulating portions 18 configured to be movable so that the range of free movement can be changed, various types of cloth can be handled.

Figure 3:
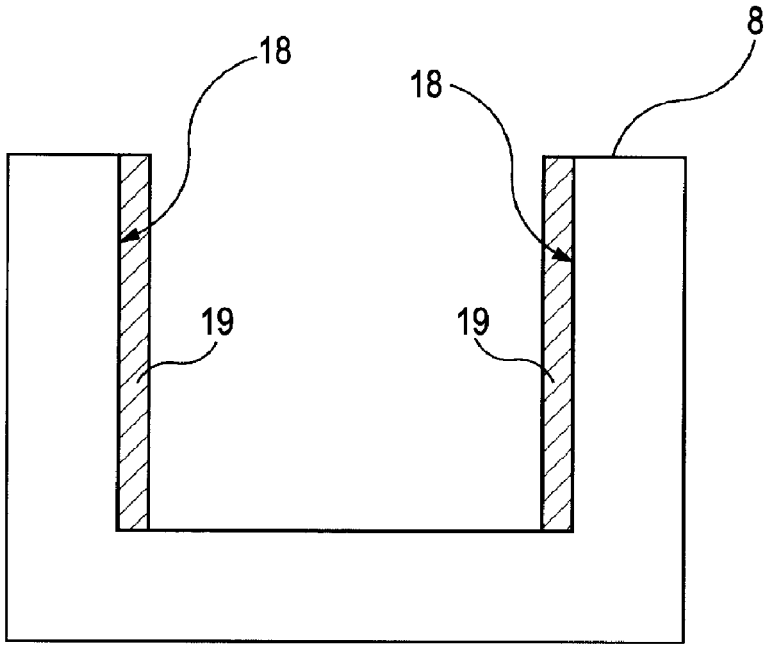
FIG. 3 shows an example of a movement regulating member.
Figure 4:
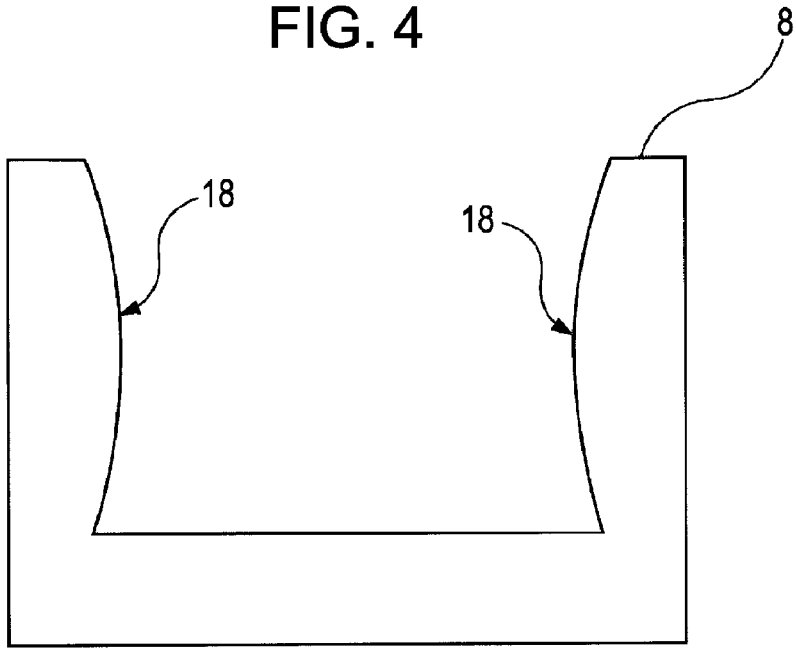
FIG. 4 shows another example of the movement regulating member.

Referring to FIG. 3, the movement regulating portions 18 of the movement regulating members 8 can be provided with resilient members 19, each serving as a roller movement promoting member that facilitates, or promotes, free movement of the free roller 5. This makes the free roller 5 that has bumped into the movement regulating portions 18 to roll more easily without stopping thereat. The resilient members 19 may be springs or resin members, for example, causing the free roller 5 to bounce thereof easily. Alternatively, referring to FIG. 4, the movement regulating portions 18 may each have a convex shape that causes the free roller 5 that has bumped thereinto to easily bounce thereof. Since the free roller 5 tends to stay on the downstream side in the transporting direction, only each one of the movement regulating portions 18 on the downstream side may have the resilient member 19.

The roller movement promoting member is not limited to the resilient member 19 provided to the movement regulating portion 18, and may be a separate member having a configuration capable of pushing back the free roller 5 from the downstream side toward the upstream side and vice versa in the transporting direction.

In addition, if the transporting belt 7 is driven intermittently and the printing section 4 performs printing while the transporting belt 7 is stopped, the free roller 5 can move more easily with a rebound produced by the intermittent driving of the transporting belt 7. Consequently, air trapped between the cloth 2 and the transporting belt 7 can be efficiently dispersed and the cloth 2 on the transporting belt 7 can be flattened.

Second Embodiment

Figure 5A:
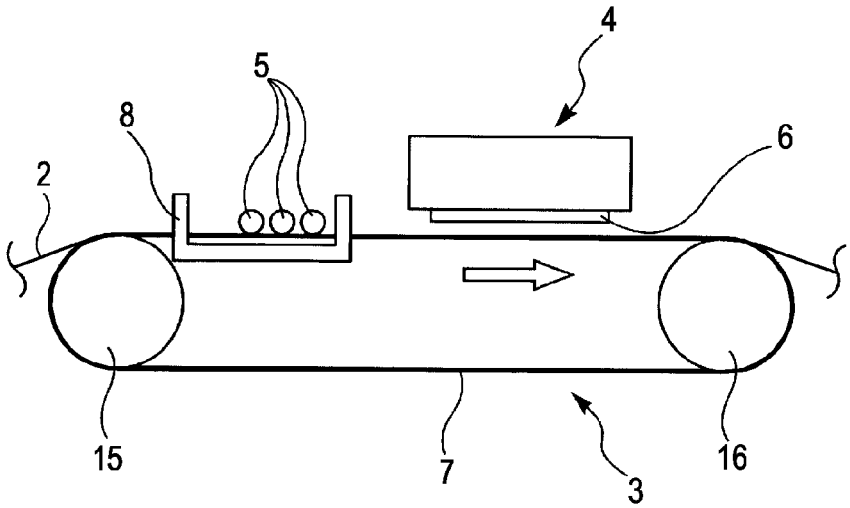
FIG. 5A is a side view showing another example of the lifting preventer of the ink jet textile printing apparatus according to the first embodiment of the invention, in a case where a plurality of free rollers are provided within a predetermined range.
Figure 5B:
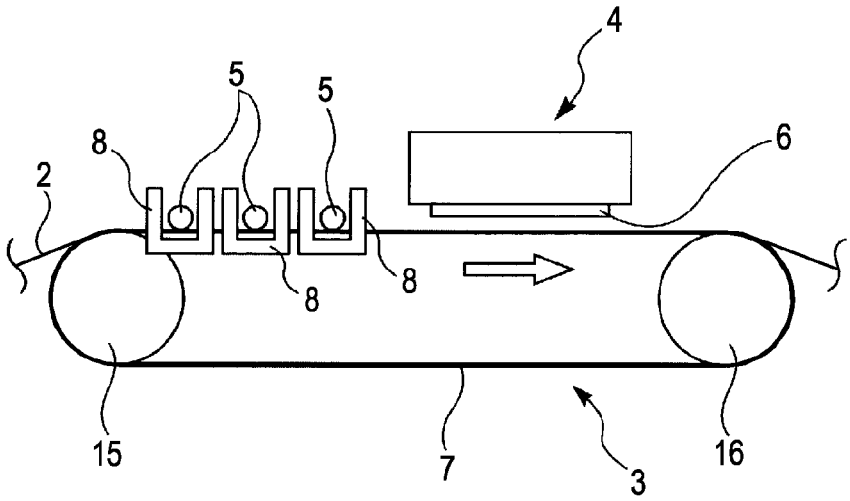
FIG. 5B is a side view showing yet another example of the lifting preventer of the ink jet textile printing apparatus according to the first embodiment of the invention, in a case where the free rollers are each provided with a movement regulating member.

A second embodiment of the invention concerning the lifting preventer of the ink jet textile printing apparatus 1 according to the first embodiment of the invention will be described. Referring to FIGS. 5A and 5B, a lifting preventer of the second embodiment includes a plurality of free rollers 5 arranged in the transporting direction in which the transporting belt 7 is rotated. FIG. 5A shows a case where the free rollers 5 are provided within a predetermined range. FIG. 5B shows a case where the free rollers 5 are each provided with a movement regulating member 8.

Referring to FIG. 5A, if all of the free rollers 5 are provided in a predetermined range, the free rollers 5 bump into each other and make individually different movements. With such individual "irregular movements" of the free rollers 5, air trapped between the cloth 2 and the transporting belt 7 can be efficiently dispersed.

Alternatively, referring to FIG. 5B, the movement regulating member 8 may be provided for each of the free rollers 5. With the movement regulating members 8 provided to the respective free rollers 5, the movable ranges of the free rollers 5 can be made to differ, for example, in order from the upstream side toward the downstream side in the transporting direction (indicated by the white arrow in FIG. 5B). Thus, the "irregular movements" of the free rollers 5 can be controlled more minutely in accordance with the type and thickness of the cloth 2, i.e., the recording medium.

Figure 6:
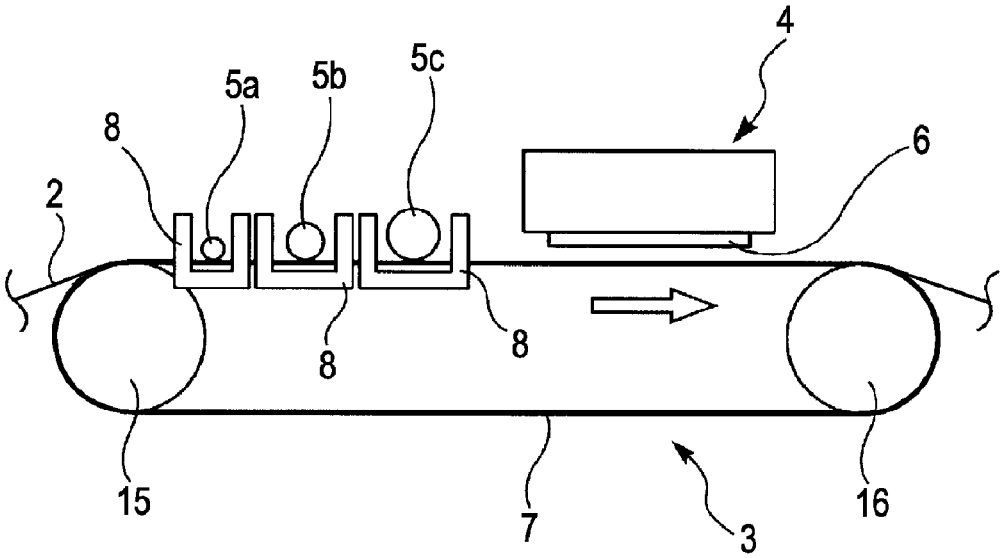
FIG. 6 is a side view showing yet another example of the lifting preventer of the ink jet textile printing apparatus according to the first embodiment of the invention.

As another alternative, referring to FIG. 6, a plurality of free rollers 5*a*, 5*b*, and 5*c* may be provided with respective diameters increasing in order from the upstream side toward the downstream side in the transporting direction. In a case where the free rollers are all made of the same material, the weights of the free rollers increase with the increase of the diameters thereof.

In a case where a large amount of air is trapped in a region between the cloth 2 and the transporting belt 7, if a free roller having a large diameter and a heavy weight directly rolls over the region, the cloth 2 may wrinkle.

According to the second embodiment, such a large air-lifted region can be first made smaller to some extent, without causing the cloth 2 to wrinkle, by the free roller 5*a* having the smallest diameter and the smallest weight and disposed at the most upstream position in the transporting direction. There are also provided the free roller 5*b* having an intermediate diameter and the free roller 5*c* having the largest diameter disposed in that order toward the downstream side. In such a configuration, the air-lifted region that has been made smaller to some extent by the free roller 5*a* having the smallest diameter and the smallest weight is made even smaller, while the air thereinside is dispersed, by the free roller 5*b* having the intermediate diameter and heavier than the free roller 5*a*. Lastly, the free roller 5*c* having the largest diameter and heavier than the free roller 5*b* assuredly smoothes out the cloth 2. Therefore, even if the cloth 2 easily allows a large amount of air to be trapped thereunder on the transporting belt 7, the air can be dispersed evenly and the cloth 2 can be flattened without becoming wrinkled.

Third Embodiment

Figure 7:
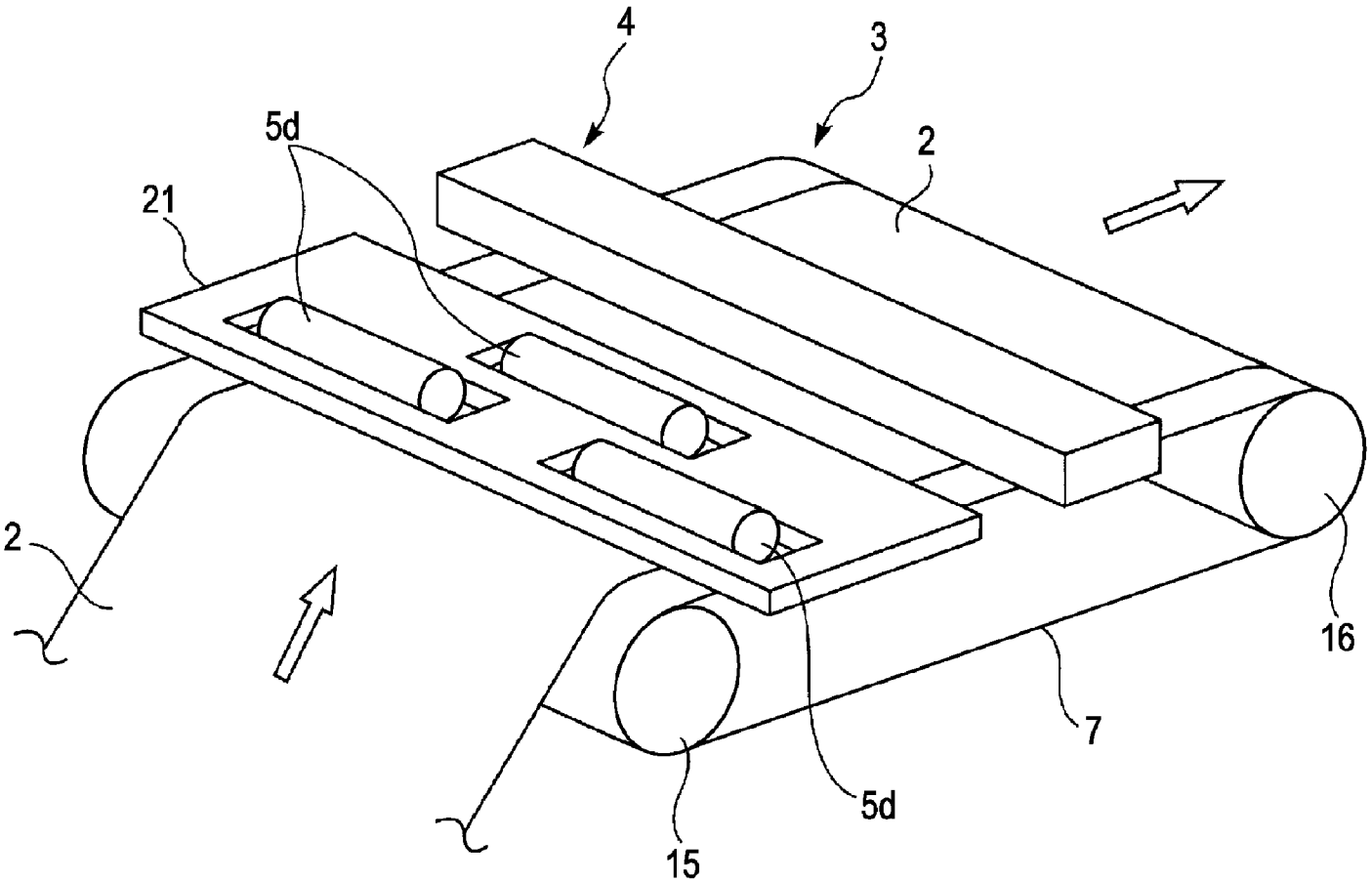
FIG. 7 is a perspective view showing yet another example of the lifting preventer of the ink jet textile printing apparatus according to the first embodiment of the invention.

A third embodiment of the invention concerning the lifting preventer of the ink jet textile printing apparatus 1 according to the first embodiment of the invention will be described. FIG. 7 is a perspective view showing another exemplary configuration, according to the third embodiment, of the lifting preventer of the ink jet textile printing apparatus 1 according to the first embodiment.

A lifting preventer of the third embodiment includes a plurality of free rollers 5*d* having a length smaller than the width of the cloth 2. The free rollers 5*d* are held by a plate-like roller holding member 21 having openings 22, each serving as a frame enclosing the respective free rollers 5*d*. The sizes of the openings 22 are set in such a manner as to allow the respective free rollers 5*d* to make the "irregular movements" described in the first embodiment.

The free rollers 5*d* having small lengths make smaller irregular movements when rolling. Therefore, air trapped between the cloth 2 and the transporting belt 7 can be efficiently dispersed, whereby the cloth 2 on the transporting belt 7 can be flattened. Particularly, in a case where the cloth 2 has a large width, it is advantageous to use the plurality of free rollers 5*d* of the third embodiment that have lengths smaller than the width of the cloth 2.

Figure 8:
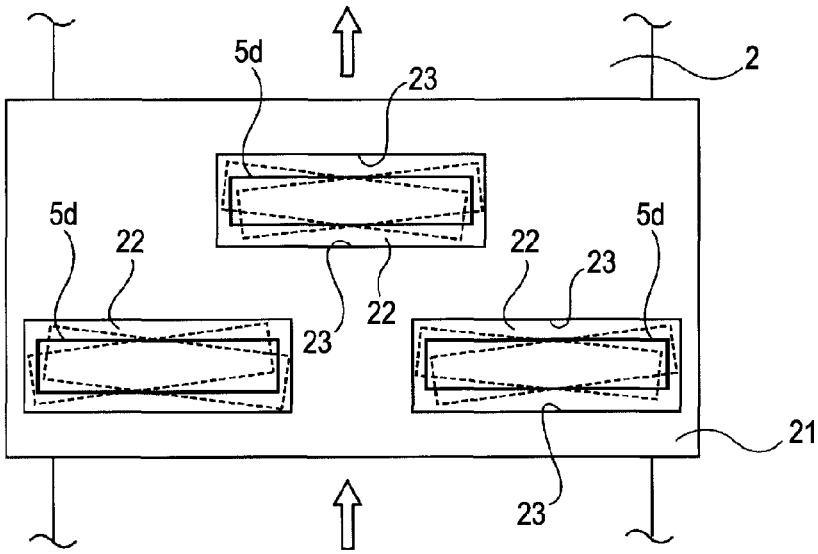
FIG. 8 shows an example of a roller holding member that holds the free rollers.

In an exemplary configuration shown in FIG. 8, the free rollers 5*d* are arranged over the entire width of the cloth 2, i.e., the recording medium, in such a manner that adjacent ones of the free rollers 5*d* have portions thereof overlapping each other in the width direction of the cloth 2 so that lifting of the cloth 2 can be prevented by any of the free rollers 5*d*.

Figure 9:
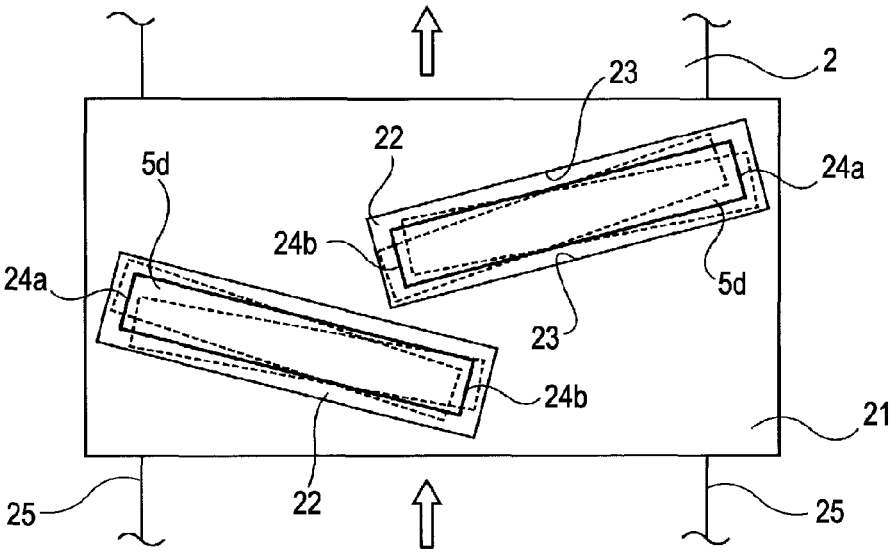
FIG. 9 shows another example of the roller holding member that holds the free rollers.
Figure 10:
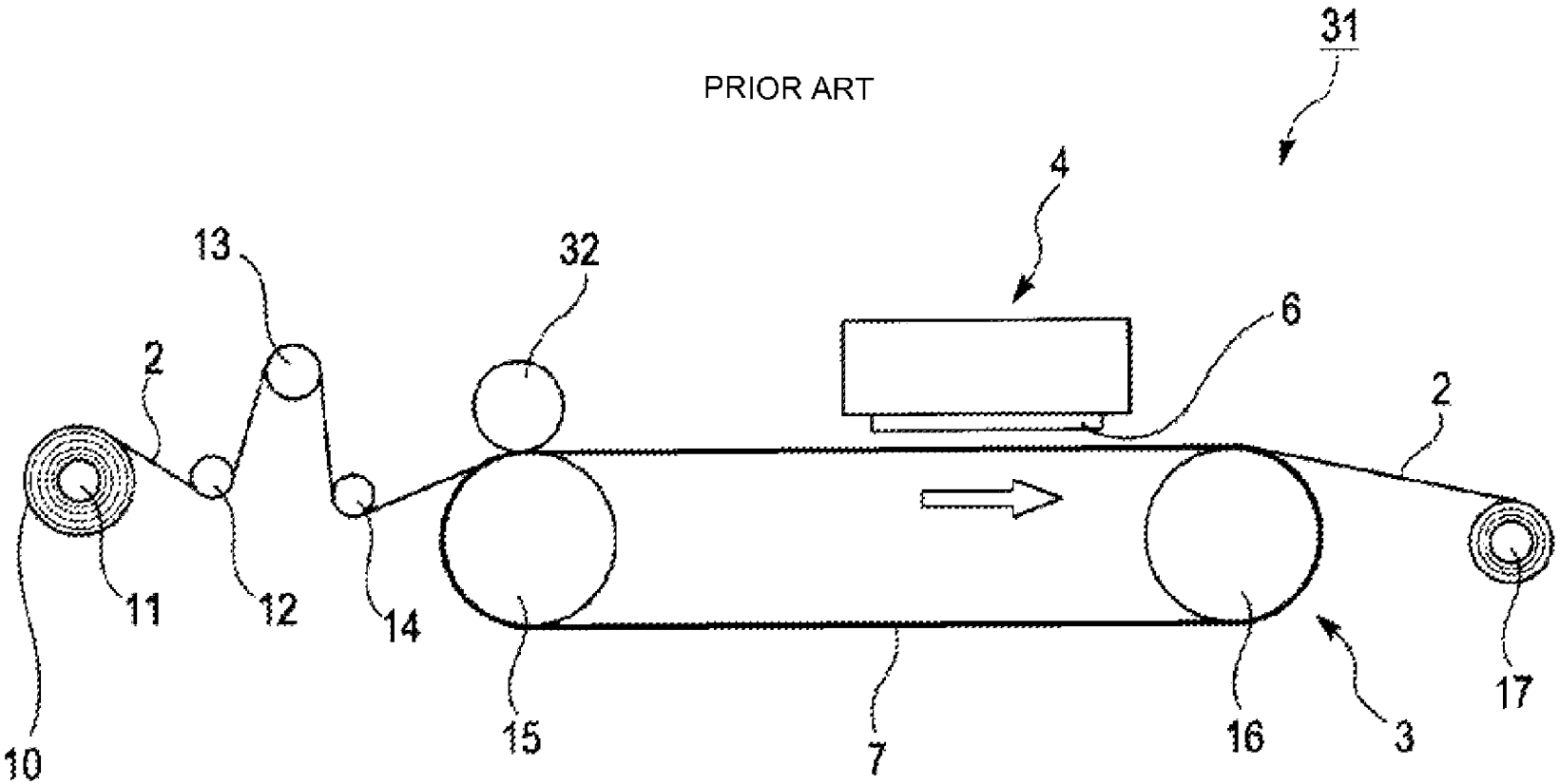
FIG. 10 PRIOR ART
FIG. 10 schematically shows relevant parts of a known ink jet textile printing apparatus.

Alternatively, referring to FIG. 9, the free rollers 5*d* may be obliquely arranged in such a manner that each of the free rollers 5*d* has one end 24*a* thereof near a corresponding side 25 of the cloth 2 resides on the downstream side in the transporting direction (indicated by the white arrows in FIG. 9) with respect to the other end 24*b* thereof. Such a configuration advantageously facilitates the movement of the free rollers 5*d* to push the air trapped under the cloth 2 toward the respective sides 25 of the cloth 2. In FIGS. 8 and 9, the dotted lines shown inside the openings 22 shows the traces of the free rollers 5*d* making "irregular movements".

In the case where there is a relatively small probability of occurrence of an air-lifted region that is so large as to interfere with the recording head 6 of the printing section 4 and printing is to be performed only on a portion of the cloth 2, the free rollers 5*d* having small lengths may be arranged only in that portion of the cloth 2 on which printing is to be performed, so as to evenly disperse the air trapped therein, whereby the widthwise range within which the free rollers 5*d* roll can be limited.

The surfaces of the free rollers 5*d* are brought into contact with portions 23 of the roller holding member 21 defining the openings 22. By providing the resilient members 19 to the portions 23 or making the portions 23 in a shape causing the free rollers 5*d* to easily bounce thereoff, the free movements of the free rollers 5*d* can be realized more easily.

The invention can be applied to ink jet textile printing apparatuses that each perform printing on a textile by ejecting ink from an ink jet recording head.

What is claimed is:

1. An ink jet apparatus comprising:

a printing section having a recording head and performing printing on a recording medium by ejecting ink from the recording head;

a transporting belt having an adhesive surface; and a lifting preventer disposed on an upstream side with respect to the printing section in a transporting direction in which the transporting belt is rotated, wherein the lifting preventer includes a free roller that is provided over the recording medium, wherein the free roller is supported by the transporting belt and is movable in the transporting direction and in a direction opposite to the transporting direction.

2. The ink jet apparatus according to claim 1, wherein the free roller includes a plurality of the free rollers arranged in the transporting direction, the free rollers having respective diameters that increase in order from a most upstream one to a most downstream one in the transporting direction.

3. The ink jet apparatus according to claim 1, wherein the transporting belt is driven intermittently.

4. The ink jet apparatus according to claim 1, further comprising:

a movement regulating member that regulates a range within which the free roller moves.

5. The ink jet apparatus according to claim 1, further comprising:

a roller movement promoting member that promotes movement of the free roller.

6. The ink jet apparatus according to claim 5, wherein the roller movement promoting member is a resilient member including a spring or a resin member, or has a shape enabling the free roller that has bumped thereinto to easily bounce thereof.

7. The ink jet apparatus according to claim 1, wherein the lifting preventer includes a plurality of the free rollers having lengths smaller than a width of the recording medium, the free rollers each being arranged obliquely in such a manner as to have one end thereof near a side of the recording medium which resides on a downstream side in the transporting direction with respect to the other end thereof.

8. The ink jet apparatus according to claim 1, wherein the transporting belt is rotated by a transporting roller and the free roller is provided downstream of the transporting roller in the transporting direction without facing the transporting roller.

9. The ink jet apparatus according to claim 1, wherein the free roller is provided over the recording medium without receiving a force pressing the free roller to the recording medium.

* * * * *